US006666745B1

(12) United States Patent
Lund et al.

(10) Patent No.: US 6,666,745 B1
(45) Date of Patent: Dec. 23, 2003

(54) HOP ALONG DOLL

(75) Inventors: Bruce D. Lund, Chicago, IL (US); Krishnan Srirangam, Chicago, IL (US)

(73) Assignee: Lund and Company, Chicago, IL (US)

( * ) Notice: Subject to any disclaimer, the term of this patent is extended or adjusted under 35 U.S.C. 154(b) by 0 days.

(21) Appl. No.: 10/228,379

(22) Filed: Aug. 27, 2002

(51) Int. Cl.[7] ..... A63H 3/00

(52) U.S. Cl. ..... 446/268; 446/308; 446/312; 446/330

(58) Field of Search ..... 446/268, 307, 446/308, 311, 312, 364, 366, 325

(56) References Cited

U.S. PATENT DOCUMENTS 1,594,649 A * 8/1926 Traiumann
3,452,473 A * 7/1969 Convertine
3,603,030 A * 9/1971 Bart et al.
3,650,066 A * 3/1972 Amici et al.
3,744,182 A * 7/1973 Terzian et al.
4,037,357 A * 7/1977 Monroe et al.
5,376,039 A * 12/1994 Balgin ..... 446/307
5,827,107 A * 10/1998 Bears et al. ..... 446/263
5,839,939 A * 11/1998 Ohi ..... 446/175
5,941,755 A * 8/1999 Danielian ..... 446/312
6,017,261 A * 1/2000 Wachtel ..... 446/301
6,247,993 B1 * 6/2001 Feldman ..... 446/307

* cited by examiner

*Primary Examiner*—Derris H. Banks
*Assistant Examiner*—Ali Abdelwahed
(74) *Attorney, Agent, or Firm*—Much Shelist

(57) ABSTRACT

The present invention includes a doll that has a torso hingedly attached to a pair of legs. Springs are attached to the torso and legs for exerting a spring force that keeps the torso and legs in a substantially planar position. A motor mechanism attached to the torso and legs for moving the torso and legs towards each other against the springs. A circuit board in communication with the motor mechanism controls the torso and legs such that the doll hops along a surface.

16 Claims, 3 Drawing Sheets

HOP ALONG DOLL

BACKGROUND OF THE INVENTION

Dolls have always been the mainstay as a toy for young children. There have been numerous varieties of dolls from no interaction to fully interactive dolls. There exist dolls that speak, cry, sing and laugh in response to a child touching or squeezing various parts of the doll, as well as dolls that walk and crawl. However, there are always a continual need for improvements and new and novel features.

SUMMARY OF THE INVENTION

There is herein described and illustrated a unique animated doll that is hinged at the hips or waist. The hinged hips permit the doll to bend at the waist and spring back to an upright position causing the doll sit hop along the surface. Preferably, various items such as a pogo stick or a stick horse are used with the doll to help keep the doll upright during the hopping movement.

Numerous other advantages and features of the invention will become readily apparent from the following detailed description of the invention and the embodiments thereof, from the claims, and from the accompanying drawings.

BRIEF DESCRIPTION OF THE DRAWINGS

A fuller understanding of the foregoing may be had by reference to the accompanying drawings, wherein.

DETAILED DESCRIPTION OF THE DRAWINGS

Figure 2A:
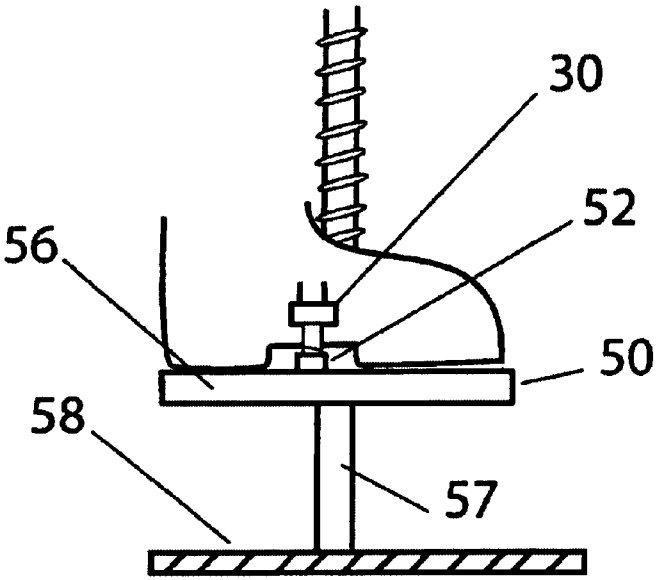
FIG. 2*a* is a side view of the doll from FIG. 1 illustrating the foot switch and the interconnection between the foot and the pogo.

While the invention is susceptible to embodiments in many different forms, there are shown in the drawings and will be described herein, in detail, the preferred embodiments of the present invention. It should be understood, however, that the present disclosure is to be considered an exemplification of the principles of the invention and is not intended to limit the spirit or scope of the invention and/or claims of the embodiments illustrated.

Figure 1:
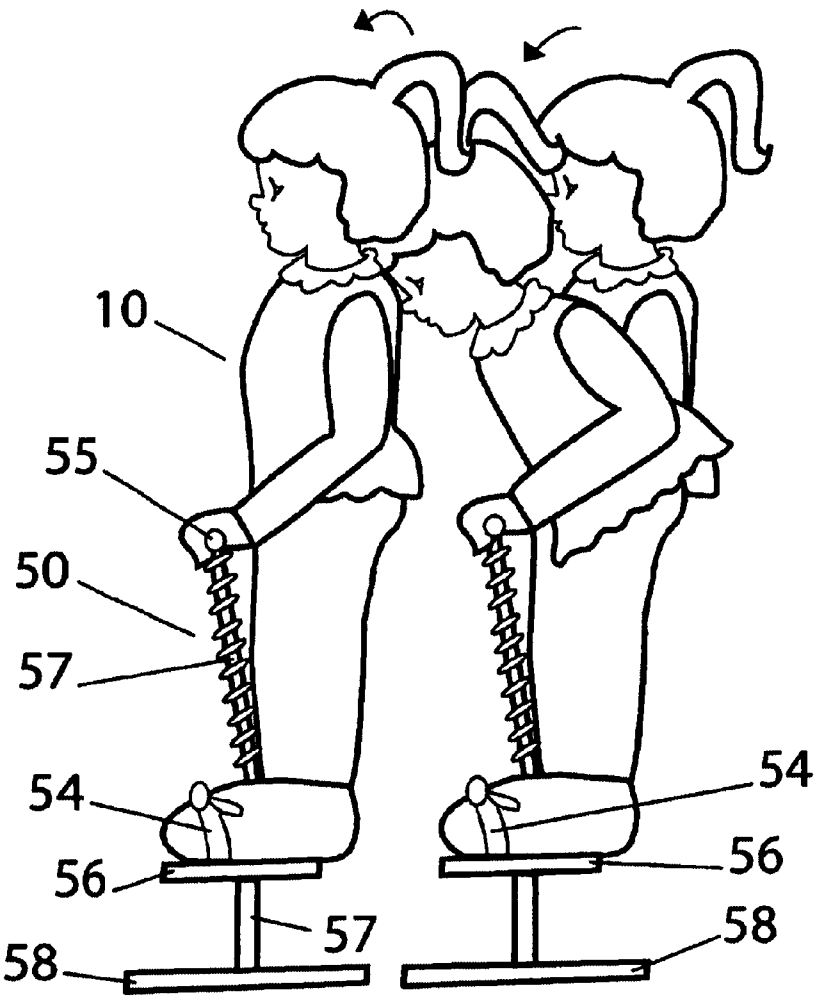
FIG. 1 is a side view of a doll in a moving illustration hopping from a first position to a second position.
Figure 3A:
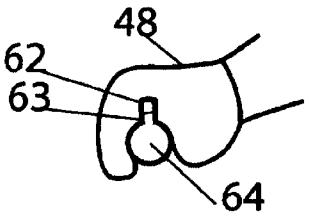
FIG. 3 is a side view of the doll from FIG. 1 in another moving illustration hopping along a surface while riding a stick animal and FIG. 3*a* is an enlarged view of the hand switch, pin and handle assembly.
Figure 3:
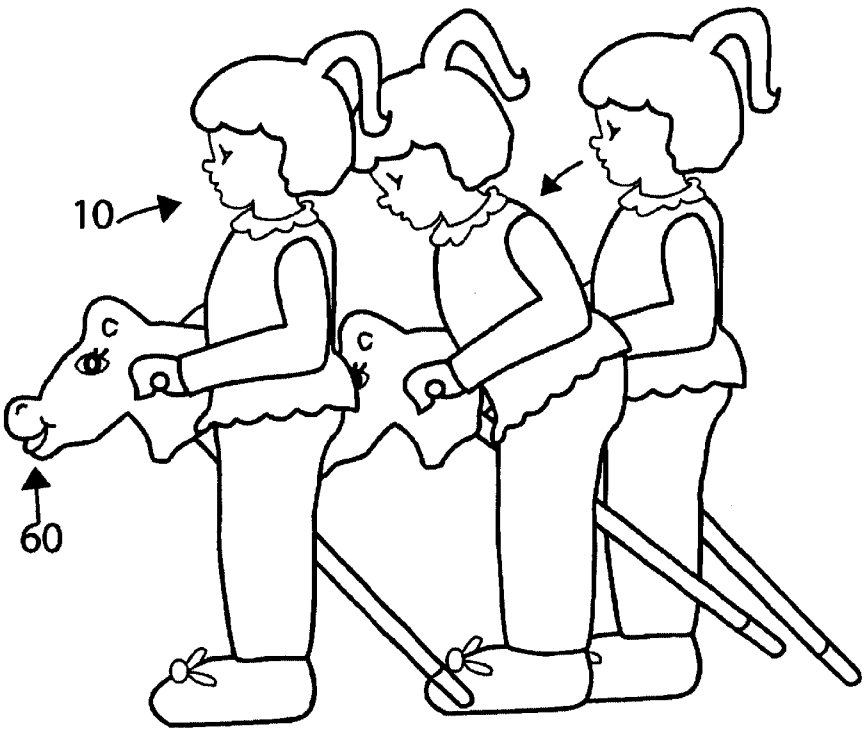

Referring now to FIGS. 1 and 3, a doll 10 in accordance with the present invention is illustrated hopping from one point to another point, along a surface. In FIG. 1, the doll 10 is placed on a pogo stick 50, while in FIG. 3 the doll 10 is shown hopping from one point to another point on an stick animal 60 or more commonly referred to as a stick horse, the stick animal is defined as having an animal shaped head attached to the end of an elongated rod. The movements are further discussed in the detailed discussion of the operation of the doll 10.

Figures 4A, 4B:
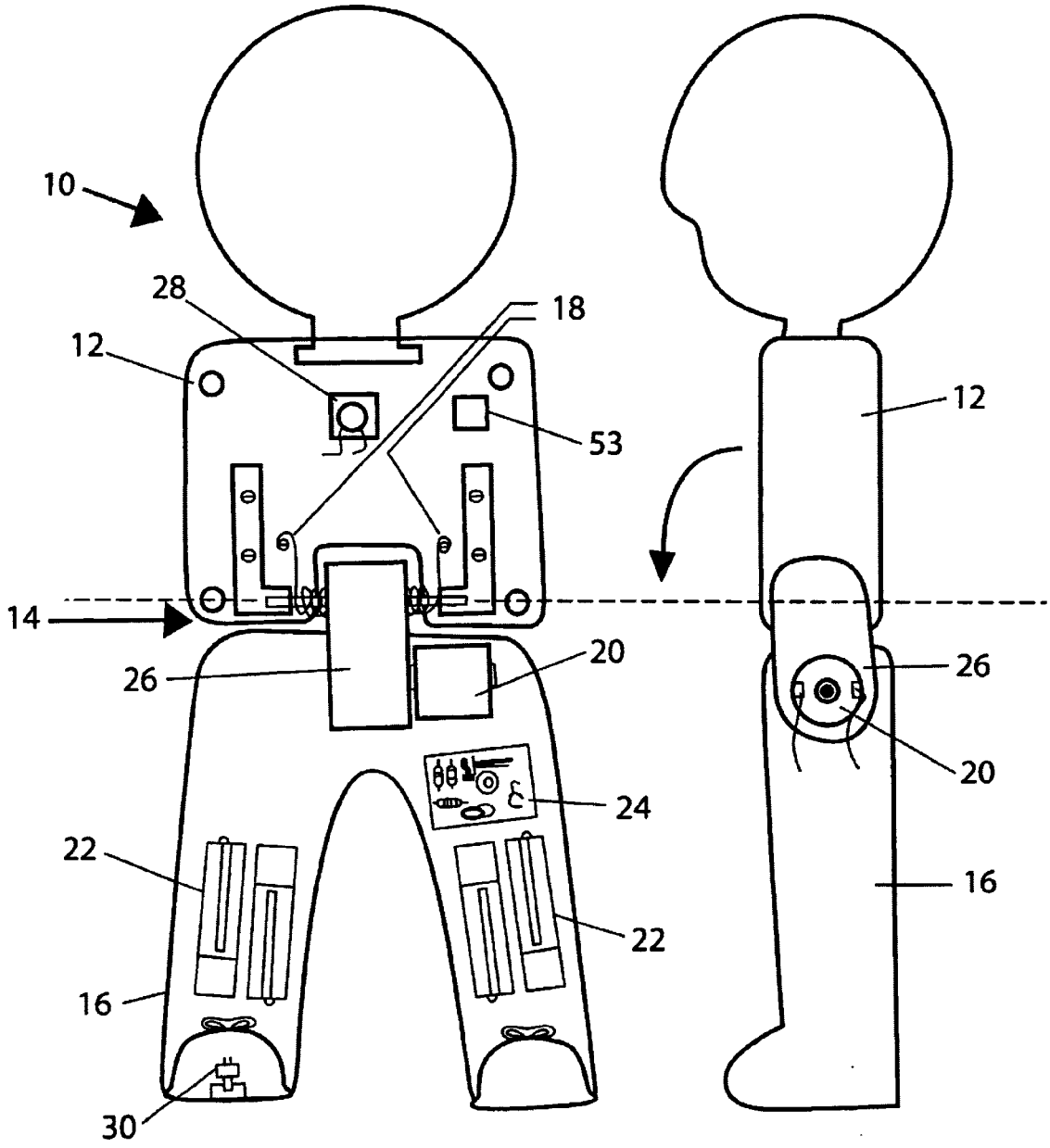
FIG. 4*a* is a front view of the respective components of the doll to accomplish the movements described hereinbelow.
FIG. 4*b* is a side view of FIG. 4*a;*

Referring now to FIGS. 4*a* and 4*b* the components to achieve the movements described above are illustrated. The doll 10 includes an upper half 12 or torso hingedly attached at a mid section 14 to a gearbox 26 that is further attached to a lower half 16 or legs. The upper and lower halves may also represent the upper half of the doll body and lower half of the doll body. A pair of springs 18 are attached to the doll 10 in a manner that causes the two halves 12 and 16 to naturally oppose each other and remain in a substantially straight configuration, such as exhibited in a standing up position. A motor mechanism 20 in communication with the gear box 26 acts to move the two halves 12 and 16 against the force of the springs 18, bringing the two halves 12 and 16 together. The motor 20 is powered by a power supply 22 and controlled through a circuit board 24.

The doll 10 is also capable of determining its current position through ball switches 28, which is in communication with the circuit board 24. The circuit board 24 receiving a signal from the ball switches 28 can then determine the current position of the doll 10. The circuit board may then select or determine another position and operate and control the motor mechanism 20 in order to move the doll 10 to the other position. The doll 10 also includes a foot switch 30, which is activated, when the doll 10 is placed on the pogo stick 50 (illustrated in FIG. 2*a*), by a pin 52 positioned on the pogo stick 50.

The specific type of movements are controlled by the circuit board 24 operating the motor mechanism at various times, rates and speeds, as well as using the opposing spring force to return the doll 10 in a substantially straight or planar position.

Figure 2B:
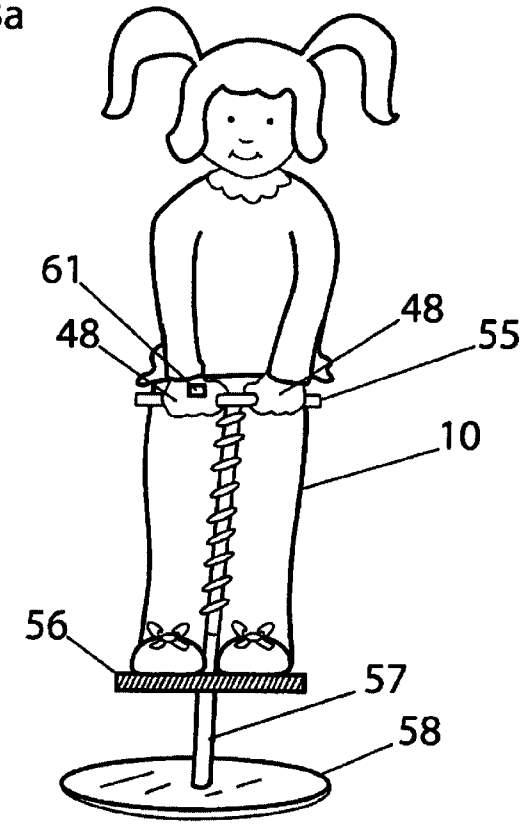
FIG. 2*b* is a front view of the doll from FIG. 1.

When the doll 10 is placed on the pogo stick 50, the pin 52 depresses the foot switch 30. The circuit board 24 receiving an indication from the foot switch 30 determines that the doll 10 is placed on the pogo stick 50. In response thereto, the circuit board 24 may emit through the speaker 53 various responses such as "I love to hop on my pogo stick." The doll 10 will then begin to hop, bounce, or move with the pogo stick 50. Balance is maintained on the pogo stick 50 because the pogo stick includes a platform 56 that the doll 10 stands on that is above a larger base platform 58, which supports the doll 10 and the pogo stick 50 on a surface. In addition, the pogo stick 50 may include straps 54 or other fastening means that secure the doll's 10 feet to the secondary platform 56. The pogo stick 50 further includes handle bars 55 for the doll's 10 hands 48 (FIG. 2*b*). The handle bars 55 are attached to the secondary platform 56 by a vertical bar 57 that extends through the secondary platform 56 to the larger base platform 58.

In yet other embodiments, the doll 10 when placed on the pogo stick 50 will indicate to the circuit board that the doll 10 is on the pogo stick 50 but will still wait activation by the user. To activate the user would press a switch located on the doll 10.

The doll 10 can either move forward, backwards or spin around in a circle, while on the pogo stick 50, the movement is further explained below. The movement is essentially created by the circuit board's 24 control of the motor mechanism 20 in accordance to a set of preprogrammed instructions. The motor mechanism 20 is controlled such that the gear box 26 will move the two halves 12 and 16 towards or away from each other. Different pre-programmed instructions are stored on the circuit board 24 such that the doll 10 will cycle through various movements. For example, the doll 10 may hop forwards three or four times, backwards four or five times and then spin, at which point the doll 10 may stop, ending the routine. To restart the doll 10 or to cause the doll 10 to being another set of instructions, the user would press a switch located on the doll 10. This restart/start switch may be located in a hand, arm, leg, foot or even the torso.

In one set of pre-programmed instructions, the motor mechanism 20 slowly moves the torso 12 of the doll 10 forward to an angle of approximately twenty-five degrees from the upright position and jolts the torso 12 back toward the upright position for pre-determined amount of time. This movement cause the doll 10 to slide the larger base platform across the surface and hence the doll 10 itself will move forwards. As readily apparent when this is repeated the doll 10 itself will move forwards. In accordance with another set of pre-programmed instructions, when the motor mechanism 20 moves the torso 12 of the doll 10 forward approximately ten degrees from the upright position and moves the torso 12 back but continues to push against the torso 12 for approximately 0.15 seconds after the torso 12 is in the upright position, the doll 10 will spin. This is caused because the momentum of the doll 10 and the extra operation of the motor mechanism 20 together causes the doll 10 to lean backwards on the edge of the larger base platform 58, further causing the doll 10 and the pogo stick 50 to spin on the edge of the platform 58, without tipping over. It should further be noted that the order of replay of the sets of pre-programmed instructions may be random or set, such that the movement of the doll 10 exhibits a cycle.

When the doll 10 is placed on the stick animal 60 (FIG. 3) the user presses an activation switch 61 in one of the hands 48. The circuit board 24 in communication with the hand switch may emit an appropriate response through the speaker, such as "Yehaw . . . giddy up horsy!" In further response to the hand switch being activated, the motor mechanism 20 will drive and pause for precise amounts of time in accordance with a set of pre-programmed instructions in the circuit board 24. The pre-programmed instructions cause the doll 10 and the stick animal 60 to move forward. Different strides and speeds are achieved by varying the speed and movements of the motor mechanism 20. The actual movement is accomplished by the motor mechanism 20 initially moving the torso 12 forward towards the legs 16, approximately thirty-five degrees, and then reversing the movement for approximately twenty degrees. This causes the doll 10 to move forwards slowly. Since the motor mechanism 20 did not return the doll 10 to the upright position, the springs 18 carry the top half back to an upright position. A faster ride on the stick animal 60 is achieved by leaning the doll 10 to approximately twenty degrees forward and jolting back approximately fifteen degrees. In such an embodiment the circuit board may recognize that the doll 10 is attached to the stick animal because the foot switch was not activated by the pogo stick 50.

In another embodiment, FIGS. 3 and 3*a*, the doll 10 includes a recessed switch 62 on the hand 48 with a corresponding pin 63 in the handle bars 64 on the stick animal. When placed on the stick animal, the switch in the hand is activated sending a signal to the circuit board. Upon receiving the signal the circuit board may run a set of pre-programmed instructions directed to the doll 10 being on the stick animal.

From the foregoing and as mentioned above, it will be observed that numerous variations and modifications may be effected without departing from the spirit and scope of the novel concept of the invention. It is to be understood that no limitation with respect to the specific methods and/or apparatus illustrated herein is intended or should be inferred. It is, of course, intended to cover by the appended claims all such modifications as fall within the scope of the claims.

We claim:

1. A doll in combination with a pogo stick comprising:

a doll having a torso hingedly attached to a pair of legs, a motor mechanism attached to the torso and legs for moving the torso towards and away from the legs, a circuit board in communication with the motor mechanism moves the torso towards and away from the legs in accordance with a set of pre-programmed instructions, and a means for activating the circuit board to control the motor mechanism; and a pogo stick defined as having a base platform that is positioned on a surface, a secondary platform positioned above the base platform, the secondary platform intended to support feet attached to the legs of the doll, and a support rod extending from the base platform through the secondary platform to a pair of handle bars, the handle bars intended to support hands defined by the doll, wherein upon activation, the circuit board in accordance with the set of preprogrammed instructions moves the torso towards and away from the legs in such a manner as to cause the doll and the pogo stick to move.

2. The combination in claim 1, wherein:

the doll feet include a bottom portion and the doll further includes a foot switch on the bottom portion of one of the feet, the foot switch when activated sends a signal to the circuit board that indicates to the circuit board that the doll is attached to the pogo stick, and the pogo stick includes a pin on the secondary platform that activates the foot switch, when the doll is placed on the pogo stick.

3. The combination of claim 1, wherein the circuit board includes a second set of pre-programmed instructions that moves the torso towards and away from the legs such that the doll spins about an edge defined on the base platform of the pogo stick.

4. The combination of claim 1, wherein the doll further includes a speaker that emits pre-programmed sounds.

5. A doll in combination with a stick animal comprising:

a doll having a torso hingedly attached to a pair of legs, a motor mechanism attached to the torso and legs for moving the torso towards and away from the legs and a circuit board in communication with the motor mechanism to move the torso towards and away from the legs in accordance with a set of pre-programmed instructions; and a stick animal that is defined as having an animal shaped head attached to an elongated rod and a pair of handles extended away from the animal shaped head that are received in hands defined by the doll, wherein upon activations the circuit board in accordance with the set of preprogrammed instructions moves the torso towards and away from the legs in such a manner as to cause the doll and the stick animal to move.

6. The combination of claim 5 wherein the doll further includes an activation switch that when pressed activates the circuit board.

7. The combination of claim 5 wherein:

the doll further includes an activation switch that when pressed activates the circuit board, and the stick animal includes a pin on one of the handles that is positioned to engage the activation switch in a hand of the doll when the doll is attached to the stick animal, whereby upon attaching the doll to the stick animal, the doll begins to hop.

8. The combination of claim 5, wherein the doll further includes a speaker that emits pre-programmed sounds.

9. A doll comprising: a torso hingedly attached to a pair of legs; a motor mechanism attached to the torso and legs for moving the torso towards and away from the legs, a pogo stick defined as having a base platform that is positioned on a surface; a secondary platform positioned above the base platform, the secondary platform intended to support feet attached to the legs of the doll, a vertical support rod extending from the base platform through the secondary platform to a pair of handle bars, the handle bars intended to support hands defined by the doll; and a circuit board in communication with the motor mechanism to control the movement of the torso towards and away from the legs such that the doll appears to hop along a surface.

10. The doll of claim 9, further comprising:

a switch positioned in one of the feet that when activated, signals the circuit board that the doll is attached to the pogo stick; and a pin on the secondary platform positioned to activate the switch when the doll is positioned on the secondary platform, whereby the circuit board is activated when a user places the doll on the pogo stick.

11. The doll of claim 10, wherein the motor mechanism is controlled to move the torso towards and away from the legs such that the doll spins about an edge defined on the base platform of the pogo stick.

12. The doll of claim 11 further comprising:

a switch in a hand that when pressed activates the circuit board to indicate that the doll is attached to a stick animal.

13. The doll of claim 12 wherein the stick animal includes a pin in one of the handles positioned to activate the switch in the hand.

14. The doll of claim 13 further comprising a speaker for emitting pre-programmed audio sounds.

15. The doll of claim 10 further comprising:

a stick animal that is defined as having an animal shaped head attached to an elongated rod and a pair of handles extended away from the animal shaped head that are received in hands defined by the doll; and the circuit board receiving a signal from the switch in one of the hands determines that the doll is attached to the stick animal.

16. A doll comprising: a torso hingedly attached to a pair of legs; a motor mechanism attached to the torso and legs for moving the torso towards and away from the legs, the doll including a pair of hands, a stick animal that is defined as having an animal shaped head attached to an elongated rod and a pair of handles extended away from the animal shaped head that are received in the dolls hands, and a circuit board in communication with the motor mechanism to control the movement of the torso towards and away from the legs such that the doll appears to hop along a surface.

* * * * *